US010378211B1

(12) United States Patent
Khun

(10) Patent No.: US 10,378,211 B1
(45) Date of Patent: Aug. 13, 2019

(54) SPACER DEVICE AND METHOD

(71) Applicant: Heng H. Khun, Calgary (CA)

(72) Inventor: Heng H. Khun, Calgary (CA)

( * ) Notice: Subject to any disclaimer, the term of this patent is extended or adjusted under 35 U.S.C. 154(b) by 0 days.

(21) Appl. No.: 15/944,786

(22) Filed: Apr. 3, 2018

(51) Int. Cl.
*E04C 5/16* (2006.01)
*E04B 1/41* (2006.01)
*E04B 9/18* (2006.01)

(52) U.S. Cl.
CPC ..... *E04C 5/168* (2013.01); *E04B 1/4121* (2013.01); *E04B 9/18* (2013.01); *E04B 2001/4192* (2013.01)

(58) Field of Classification Search
CPC ..... E04C 5/168; E04B 1/4121; E04B 2001/4192; E04B 9/18
USPC ..... 52/677
See application file for complete search history.

(56) References Cited

U.S. PATENT DOCUMENTS

| | | | | |
|---|---|---|---|---|
| 3,006,115 | A * | 10/1961 | Hillberg | E04F 21/05 52/365 |
| 3,044,217 | A | 7/1962 | Berry | |
| 3,191,345 | A | 6/1965 | Schwachula | |
| 3,348,347 | A | 10/1967 | Berry | |
| 4,945,704 | A * | 8/1990 | Brown, Jr. | E04C 5/168 52/699 |
| 6,282,860 | B1 | 9/2001 | Ramirez | |
| 9,708,809 | B2 * | 7/2017 | Bennett | E21D 20/025 |
| 2010/0296891 | A1 * | 11/2010 | Tsukamoto | F16B 31/021 411/1 |

FOREIGN PATENT DOCUMENTS

| | | | | |
|---|---|---|---|---|
| DE | 3922961 | | 1/1991 | |
| FR | 2536442 | A1 * | 5/1984 | E04B 1/4121 |
| GB | 2095714 | A * | 10/1982 | E04B 1/4121 |
| JP | H05280100 | A | 10/1993 | |
| JP | H07150687 | | 6/1995 | |
| JP | 2007100307 | | 4/2007 | |
| JP | 2015200093 | A | 11/2015 | |
| KR | 101103358 | B1 | 1/2012 | |
| WO | 1986004631 | | 8/1986 | |
| WO | WO-9004691 | A1 * | 5/1990 | E04B 9/18 |
| WO | 2008029962 | A1 | 3/2008 | |

* cited by examiner

*Primary Examiner* — Jeanette E Chapman
(74) *Attorney, Agent, or Firm* — Integrity Patent Group, PLC; Charles E. Runyan

(57) ABSTRACT

A spacer device includes a spacer having a n aperture through a bottom-side that sits against the surface of the form. The aperture is configured for providing a threaded-fixture having internal-threads, the threaded-fixture including a securing assembly insertable into the threaded-fixture. The securing assembly includes external-threads for mating with the internal-threads of the threaded-fixture. The spacer device is useful for providing a novel securing means for securing with reinforcing steel in a spaced relation for in a concrete structure or other such structure.

11 Claims, 5 Drawing Sheets

SPACER DEVICE AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of building construction of existing art and more specifically relates to spacers.

RELATED ART

In modern building construction, spacers and reinforcing steel are used to support the infrastructure (wall, column, beams, and slabs). The spacers are left in place while the concrete is pour to keep the reinforcing in place and become a permanent part of the structure. After the slabs are poured and measurements are made, the locations are marked, then drilled by a skilled drill operator in order to introduce holes in the slab for adding attachments. Each hole typically has to be drilled by hand after measurements are taken. This process is repeated many times during daily construction leading to inefficiency in time and budget. Therefore, a suitable solution is desired.

WO Pub. No. 2008/029962 to Young-Oh Choi relates to a spacer having an anchor bolt mounting portion thereon. The described spacer having an anchor bolt mounting portion thereon includes a spacer having an anchor bolt mounting portion. An anchor bolt mounting portion is provided in the spacer itself that is inserted between a mold bottom plate and a steel reinforcement, and the spacer has a very simple structure. Thus, it is not required to drill an anchor bolt mounting hole after curing a concrete building, and it is possible to reduce costs and processes due to the simple structure and also to enhance the strength of a building.

SUMMARY OF THE INVENTION

In view of the foregoing disadvantages inherent in the known spacer art, the present disclosure provides a novel spacer device and method. The general purpose of the present disclosure, which will be described subsequently in greater detail, is to provide a spacer device and method for providing a novel securing means for supporting reinforcing steel in a spaced relation in a concrete structure.

A spacer device is disclosed herein. The spacer device includes a spacer having a front-side opposite a rear-side, a left-side opposite a right-side, and a bottom-side opposite a top-side. The spacer may include an aperture through the bottom-side, and including a first-end, a second-end, and a length therebetween. The aperture may be configured for providing a threaded-fixture having internal-threads. The threaded-fixture may include a securing assembly insertable into the threaded-fixture. The securing assembly has external-threads for mating with the internal-threads of the threaded-fixture.

According to another embodiment, a method for using a spacer device is also disclosed herein. The method for using the spacer device includes providing a spacer having a front-side opposite a rear-side, a left-side opposite a right-side, and a bottom-side opposite a top-side, the spacer including; an aperture through the bottom-side, and including a first-end, a second-end, and a length therebetween, the aperture configured for providing a threaded-fixture having internal-threads, the threaded-fixture including a securing assembly insertable into the threaded-fixture, the securing assembly including external-threads for mating with the internal-threads of the threaded-fixture. The method may further include supporting the reinforcing steel via the securing assembly.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a spacer device and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a spacer and more particularly to a spacer device and method as used to improve the construction of concrete structures.

Generally, spacers are used to support reinforcing steel, which determined a desired clearance thickness between the surface of the form to the bottom of the reinforcing steel. After the slabs are poured and measurements are made, the locations are marked, then drilled by a skilled drill operator in order to introduce holes in the slab for adding attachments. The present invention provides a constructive spacer premade with holes and threaded-aperture having a mounting means already added to the spacer. There may be no need for drilling into the slab after the concrete poured. The hole in the spacer is ready to join with the threaded rod for a quick and easy installation by bolting it together. The present invention may save on skilled labor, drilling, and measuring.

Referring now more specifically to the drawings by numerals of reference, there is shown in FIGS. 1-4, various views of a spacer device 100.

Figure 1:
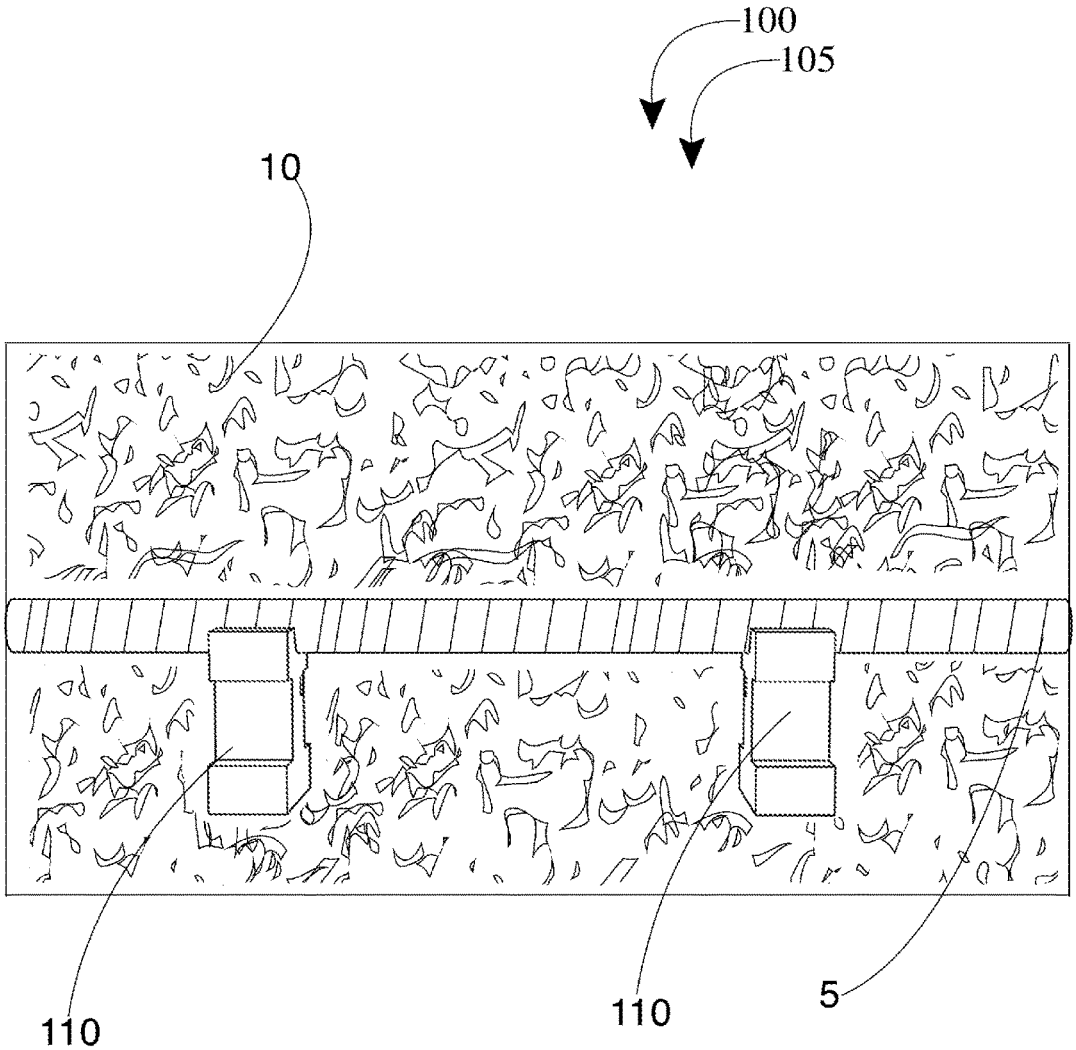
FIG. 1 is a perspective view of the spacer device, according to an embodiment of the disclosure.

FIG. 1 shows a spacer device 100, according to an embodiment of the present disclosure. Here, the spacer device 100 may be beneficial for providing a novel securing means for supporting reinforcing steel 5 in a spaced relation in a concrete structure 10. As illustrated, the spacer device 100 may include a spacer 110 having a front-side 111 opposite a rear-side 112, a left-side 113 opposite a right-side 114, and a bottom-side 115 opposite a top-side 116. The spacer 110 may be substantially rectangular as defined by the front-side 111 opposite the rear-side 112, the left-side 113 opposite the right-side 114, and the bottom-side 115 opposite the top-side 116.

The spacer 110 may include an aperture 120 through the bottom-side 115, the aperture 120 having a first-end 122, a second-end 124, and a length 126 therebetween. The aperture 120 may be configured for providing a threaded-fixture 130 having internal-threads 132. The threaded-fixture 130 may include a securing assembly (not shown) insertable into the threaded-fixture 130. The securing assembly including external-threads for mating with the internal-threads 132 of the threaded-fixture 130. The securing assembly can be understood to be a metal insert, rod, or bolt capable mating with the threaded-fixture 130.

The top-side 116 may include a recess 150 configured for placement of the reinforcing steel 5 transversely therein. The recess 150 may extend from the front-side 111 to the rear-side 112. For proper placement of the reinforcing steel 5, the recess 150 is substantially circular to embrace the reinforcing steel 5. Preferably, 10-18 mm reinforcing steel 5 may be utilized with the recess 150. The spacer 110 may be rigid such that it may be utilized with the reinforcing steel 5.

The spacer 110 may further comprise at least one indention 160 configured to maintain the spacer 110 in a fixed position once the concrete structure 10 is established. The at least one indention 160 may be positional along one of the right-side 114 and the left-side 113. The at least one indention 160 may extend into the spacer 110 by approximately 1 cm. Upon reading this specification, it should be appreciated that, under appropriate circumstances, considering such issues as user preferences, design preference, structural requirements, marketing preferences, cost, available materials, technological advances, etc., other spacer arrangements such as, for example, utilizing the spacer 110 outside of concrete structures 10, etc., may be sufficient.

In an alternate embodiment, the aperture 120 may be modified in size to accommodate using the spacer 110 with a variety of pipes (water, electrical, etc.).

According to one embodiment, the spacer device 100 may be arranged as a kit 105. In particular, the spacer device 100 may further include a set of instructions. The instructions may detail functional relationships in relation to the structure of the spacer device 100 such that the spacer device 100 can be used, maintained, or the like, in a preferred manner.

Figure 2:
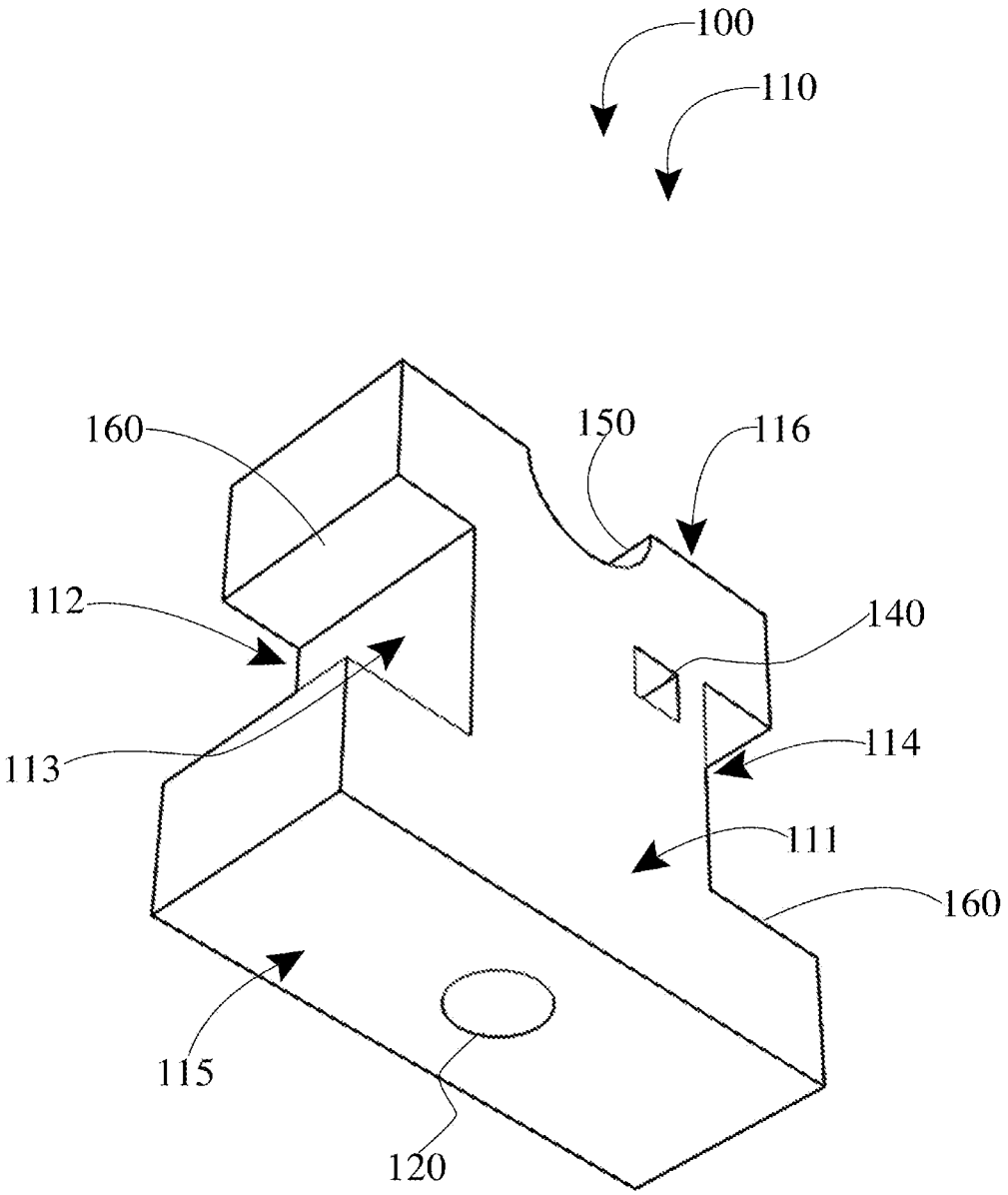
FIG. 2 is a perspective view of the spacer device of FIG. 1, according to an embodiment of the present disclosure.

FIG. 2 shows the spacer device 100 of FIG. 1, according to an embodiment of the present disclosure. As above, the spacer device 100 may include the spacer 110 having the front-side 111 opposite the rear-side 112, the left-side 113 opposite the right-side 114, and the bottom-side 115 opposite the top-side 116.

The spacer 110 may include dimensions for accommodating the reinforcing steel 5. The spacer 110 may be uniform in relation to each other such that the spacer 110 includes a uniform molding process during manufacturing to give a uniform clearance distance.

The spacer 110 may further comprise a hole 140 for threading a zip tie (not shown) therethrough. Alternatively, the zip tie may comprise any other suitable tie known in the art. The hole 140 transverses intersectionally of the recess 150 from the front-side 111 to the rear-side 112 such that the zip tie is able to secure around the reinforcing steel 5.

Figure 3:
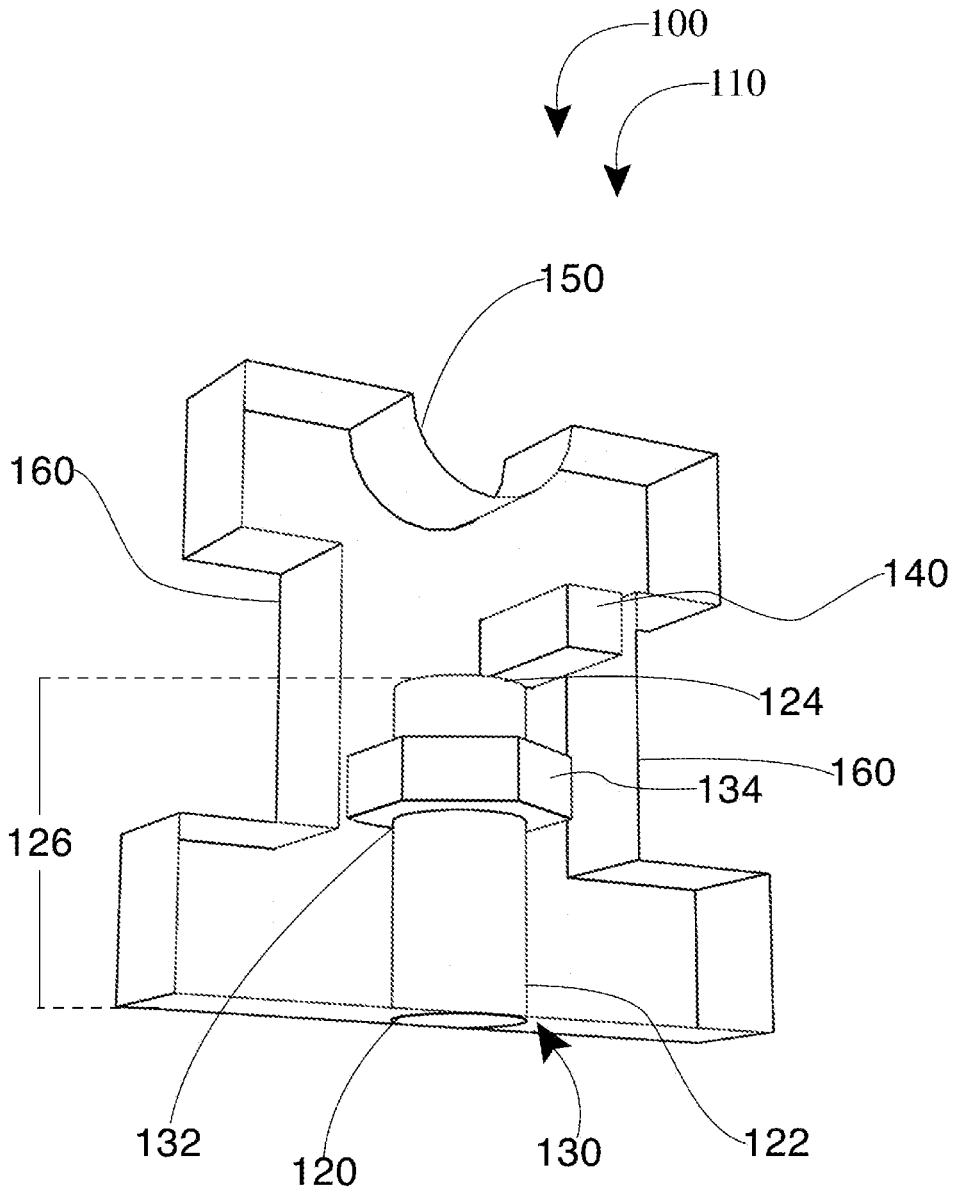
FIG. 3 is a cut-away view of the spacer device of FIG. 1, according to an embodiment of the present disclosure.

Referring now to FIG. 3, a cut-away view of the spacer device 100 of FIG. 1, according to an embodiment of the present disclosure. The spacer 110 may include the aperture 120 through the bottom-side 115, having the first-end 122, the second-end 124, and the length 126 therebetween. The length 126 of the aperture 120 extends approximately halfway from the bottom-side 115 to the top-side 116 of the spacer 110. The aperture 120 may be configured for providing the threaded-fixture 130 having the internal-threads 132. The threaded-fixture 130 may include the securing assembly (not shown) insertable into the threaded-fixture 130. The securing assembly includes external-threads for mating with the internal-threads 132 of the threaded-fixture 130. The securing assembly can be understood to be a metal insert, rod, or bolt capable mating with the threaded-fixture 130.

In one embodiment, the threaded-fixture 130 includes an incaptured threaded-nut 134. The incaptured threaded-nut 134 can be positioned along the length 126 of the aperture 120. The securing assembly may be threaded through the incaptured threaded-nut 134 for securing within the spacer 110.

Figure 4:
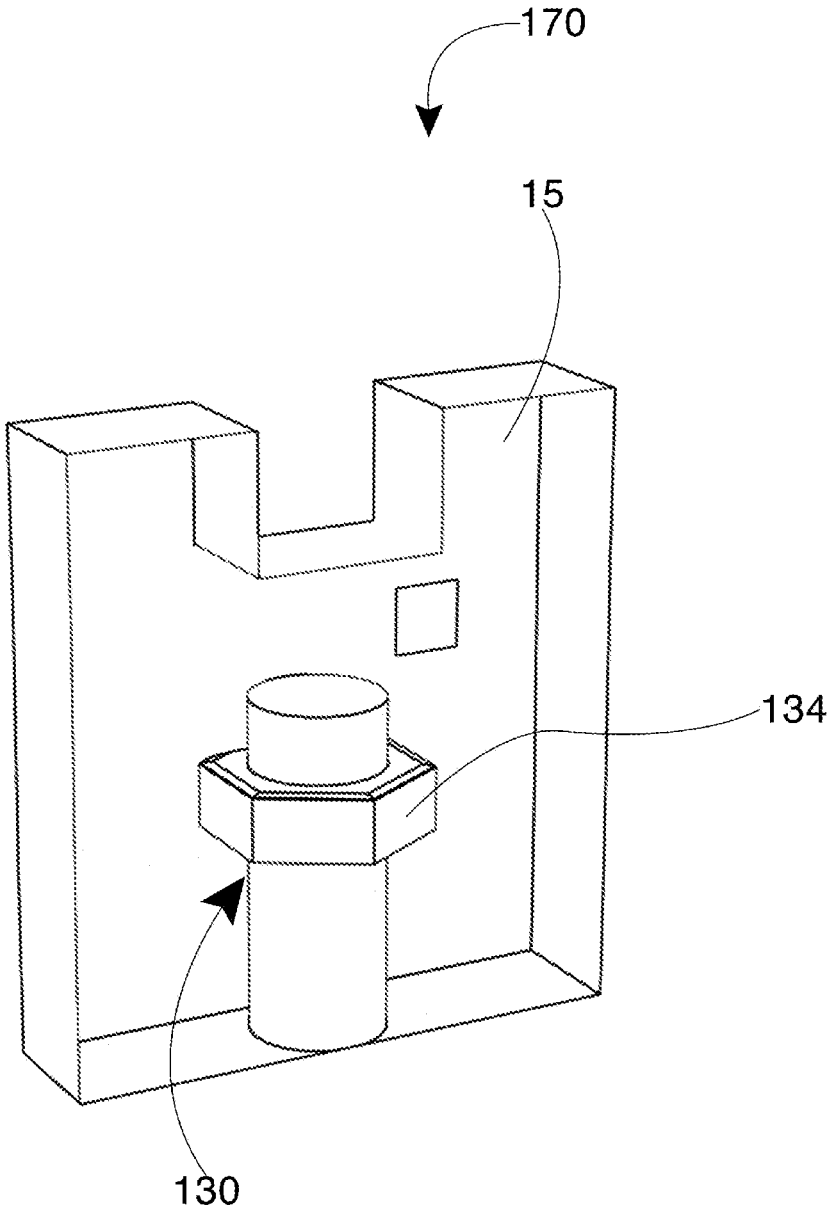
FIG. 4 is a cut-away view of the spacer device of FIG. 1, according to an embodiment of the present disclosure.

FIG. 4 is a cut-away view of an adaptor 170 of FIG. 1, according to an alternate embodiment of the present disclosure. The securing means may be utilized as the adaptor 170 that can be fitted to an existing rebar chair 15 to provide an opening in a finished slab for providing the securing means with use in the concrete structure 10. The adaptor 170 may include the threaded-fixture 130 having the internal-threads 132 and fitted within the rebar chair 15. The securing assembly may be insertable into the threaded-fixture 130. The securing assembly includes the external-threads for mating with the internal-threads 132 of the threaded-fixture 130. The threaded-fixture 130 may include the incaptured threaded-nut 134. It would be understood by those knowledgeable in the art that the rebar chair 15 is similar in function and structure as a conventional spacer. These terms can be utilized interchangeably.

In one embodiment of the adaptor 170, the threaded-fixture 130 includes a torque preventing means (not shown) such the securing assembly is easily insertable and the threaded-fixture 130 is maintained fitted within the rebar chair 15. The torque preventing means may include a T-shaped configuration.

Figure 5:
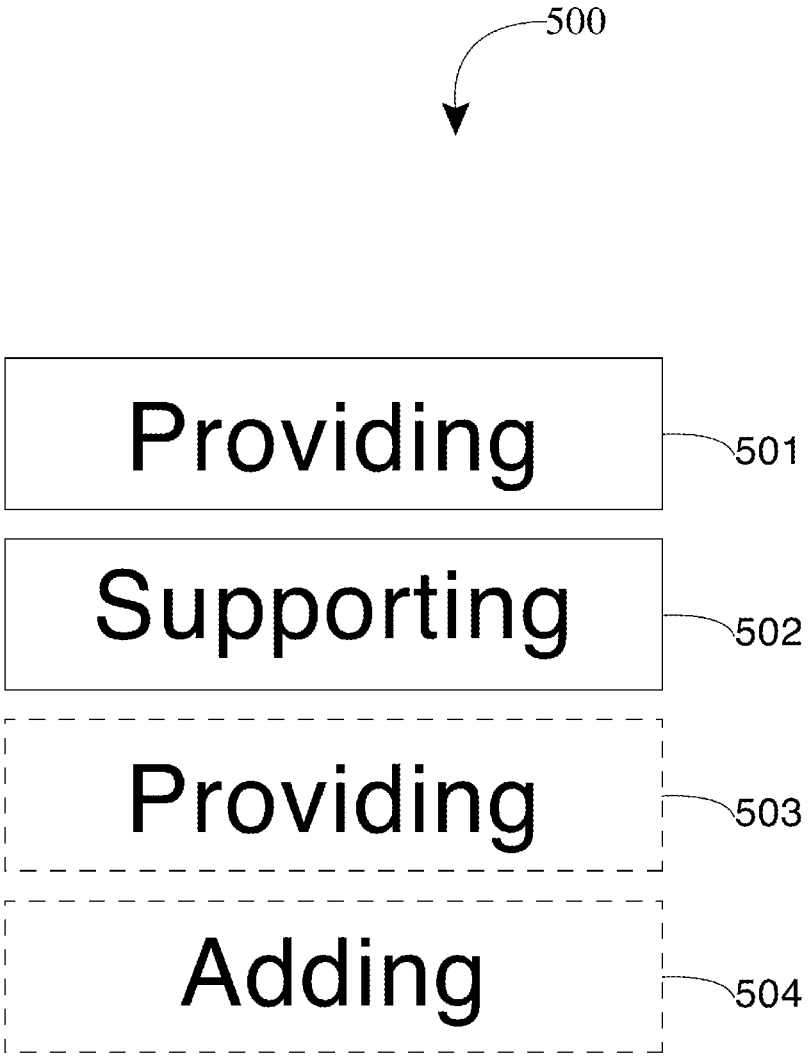
FIG. 5 is a flow diagram illustrating a method using the spacer device, according to an embodiment of the present disclosure.

Referring now to FIG. 5 showing a flow diagram illustrating a method for using a spacer device 500, according to an embodiment of the present disclosure. In particular, the method for using the spacer device 500 may include one or more components or features of the spacer device 100 as described above. As illustrated, the method for using the spacer device 500 may include the steps of: step one 501, providing a spacer 110 having a front-side 111 opposite a rear-side 112, a left-side 113 opposite a right-side 114, and a bottom-side 115 opposite a top-side 116, the spacer 110 including; an aperture 120 through the bottom-side 115, and including a first-end 122, a second-end 124, and a length 126 therebetween, the aperture 120 configured for providing a threaded-fixture 130 having internal-threads 132, the threaded-fixture 130 including a securing assembly insertable into the threaded-fixture 130, the securing assembly including external-threads for mating with the internal-threads 132 of the threaded-fixture 130; step two 502, supporting the reinforcing steel 5 via the securing assembly; step three 503, providing a rebar chair 15; and step four 504, adding an adaptor 170 to the rebar chair 15, the adapter 170 including the threaded-fixture 130 having internal-threads within the aperture 120 that can be fitted with the rebar chair 15, and the securing assembly that is insertable into the threaded-fixture 130, the securing assembly including external-threads for mating with the internal-threads 132 of the threaded-fixture 130. Those with ordinary skill in the art will now appreciate that upon reading this specification and by their understanding the art of spacers as described herein, methods of using spacers will be understood by those knowledgeable in such art.

It should be noted that steps 503 and 504 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using the spacer device 100 [NOTE: e.g., different step orders within above-mentioned list, elimination or addition of certain steps, including or excluding certain maintenance steps, etc.], are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A reinforcing steel spacer device with an improved securing means for use in a concrete structure, the spacer device comprising:

a spacer having a front-side opposite a rear-side, a left-side opposite a right-side, and a bottom-side opposite a top-side, the spacer including;

a semi-circular-recess configured to receive and support rebar, the semi-circular-recess intersecting the top-side;

an aperture through the bottom-side, and including a first-end, a second-end, and a length therebetween, the aperture configured for providing a threaded-fixture having internal-threads;

a left-recess intersecting the left-side; and a right-recess intersecting the right-side, such that the right-recess mirrors the left-recess across an axis defined by the aperture;

wherein each the left-recess and the right-recess intersect both the front-side and the rear-side;

the threaded-fixture further including a securing assembly insertable into the threaded-fixture, the securing assembly including external-threads for mating with the internal-threads of the threaded-fixture.

2. The spacer device of claim 1, wherein each of the left-recess and the right-recess are substantially rectangular in shape.

3. The spacer device of claim 1, further comprising a hole for threading a zip tie therethrough.

4. The spacer device of claim 3, wherein the hole transverses intersectionally of the semi-circular-recess from the front-side to the rear-side.

5. The spacer device of claim 1, wherein the threaded-fixture includes an incaptured threaded-nut.

6. The spacer device of claim 1, wherein the spacer is rigid.

7. The spacer device of claim 1, wherein the length of the aperture extends approximately half-way from the bottom-side to the top-side of the spacer.

8. The spacer device of claim 1, wherein the spacer is substantially rectangular as defined by the front-side opposite the rear-side, the left-side opposite the right-side, and the bottom-side opposite the top-side.

9. An adaptor able to be fitted to an existing rebar chair by being embedded within it to provide an opening in a finished slab for providing a securing means with use in a concrete structure, the adaptor comprising:

a threaded-fixture having internal-threads and fitted within a rebar chair, and a securing assembly that is insertable into the threaded-fixture, the securing assembly including external-threads for mating with the internal-threads of the threaded-fixture;

wherein the threaded-fixture includes an incaptured threaded-nut;

wherein the threaded-fixture includes a torque preventing means; and wherein the torque preventing means includes a T-shaped configuration.

10. A spacer device, the spacer device comprising:

a spacer having a front-side opposite a rear-side, a left-side opposite a right-side, and a bottom-side opposite a top-side, the spacer including;

a semi-circular-recess configured to receive and support rebar, the semi-circular-recess intersecting the top-side;

an aperture through the bottom-side, and including a first-end, a second-end, and a length therebetween, the aperture configured for providing a threaded-fixture having internal-threads;

a left-recess intersecting the left-side; and a right-recess intersecting the right-side, such that the right-recess mirrors the left-recess across an axis defined by the aperture;

wherein each the left-recess and the right-recess intersect both the front-side and the rear-side;

the threaded-fixture further including a securing assembly insertable into the threaded-fixture, the securing assembly including external-threads for mating with the internal-threads of the threaded-fixture;

further comprising a hole for threading a zip tie therethrough;

wherein the hole transverses intersectionally of the semi-circular-recess from the front-side to the rear-side;

wherein the threaded-fixture includes an incaptured threaded-nut;

wherein the spacer is rigid;

wherein the length of the aperture extends approximately half-way from the bottom-side to the top-side of the spacer; and wherein the spacer is substantially rectangular as defined by the front-side opposite the rear-side, the left-side opposite the right-side, and the bottom-side opposite the top-side.

11. The spacer device of claim 10, further comprising set of instructions; and wherein the spacer device is arranged as a kit.

* * * * *